United States Patent [19]

Link

[11] 4,074,868

[45] Feb. 21, 1978

[54] FOOD PROCESSING SYSTEM

[75] Inventor: Donald F. Link, Huntsville, Ala.

[73] Assignee: Recovery Systems, Inc., Charleston, S.C.

[21] Appl. No.: 766,132

[22] Filed: Feb. 7, 1977

[51] Int. Cl.[2] ..... B02C 13/16

[52] U.S. Cl. ..... 241/46 R; 241/46.08; 241/101.2; 241/261

[58] Field of Search ..... 241/46 R, 46 A, 46 B, 241/46.02, 46.08, 46.11, 46.17, 101.2, 101.5, 152 A, 152 R, 157, 162, 188 R, 190, 248, 257 R, 257 G, 261

[56] References Cited

U.S. PATENT DOCUMENTS

| | | | |
|---|---|---|---|
| 1,062,481 | 5/1913 | Lane | 241/261 |
| 2,063,996 | 12/1936 | Geruais | 241/257 R |
| 2,679,981 | 6/1954 | Eisinga | 241/261 |
| 2,869,795 | 1/1959 | Higer | 241/46 B |
| 3,323,728 | 6/1967 | Shepherd | 241/46 R |

*Primary Examiner*—Granville Y. Custer, Jr.
*Attorney, Agent, or Firm*—C. A. Phillips

[57] ABSTRACT

A system for pulverizing waste food and converting it into dried animal feed in which the waste food is first passed through a cylindrical chopper comprising a pivotally mounted hammer on a rotating plate which operates in relationship to a fixed cylindrical surface of lands and grooves, and thereafter, the food is passed between horizontally arranged and relatively rotating sets of lands and grooves. The material is then passed to a buffer storage tank where it is agitated to maintain consistency, and thereafter, in a constant flow provided to a rotating drum-type dryer where the material is dried and formed into flakes having a moisture content of 10 to 14 percent.

5 Claims, 4 Drawing Figures

FOOD PROCESSING SYSTEM

BACKGROUND OF THE INVENTION

1. Field of the Invention

This invention relates to the conversion of vegetable and animal matter into an emulsion, and more particularly to a system which includes improved means for pulverizing and emulsifying food stuff.

2. General Description of the Prior Art

A principal problem in the construction of a compact and economical system for the conversion of waste food, including bones and tough fibers, to dried animal feed is that of breaking down the food into sufficiently small particles and to accomplish this economically. Heretofore it has been found that the particle size should be reduced down to a maximum cross section of approximately 0.03 inch in order to achieve consistency in drying and sterilization. The applicant is unaware of the existence of any single apparatus for accomplishing this, it having been the known practice of utilizing staged breakers, cutters, and even then the results were not entirely satisfactory. Particularly, it has been most difficult to obtain uniformity in particle size from a variety of waste food sources.

Accordingly, it is an object of this invention to provide an improved waste food conversion system of the character described wherein there is achieved a more uniform pulverization with a variety of waste foods. A further object is to provide a pulverizer which is compact and sufficiently low in cost for it to be employed at sources of waste food, such as in restaurants and cafeterias.

SUMMARY OF THE INVENTION

In accordance with this invention, pulverization is achieved by a device having two basic parts, a rotor and a stator. The stator has a series of vertically and circumferentially spaced lands on an inner surface of a tubular portion of it and a series of radially and circumferentially lands on the underside of a plate portion which extends radially outwardly and horizontally from a bottom end of the tubular portion. The rotor member, generally in the form of a rotating plate, includes a pivotally attached hammer which operates between lands on the tubular portion of the stator and radially and circumferentially spaced lands which rotate within the horizontally arranged lands of the stator. As one feature of the invention, the hammer has at least one surface region which is inclined at an angle of less than 90 degrees with respect to the horizontal.

DETAILED DESCRIPTION OF THE DRAWINGS

Figure 2:
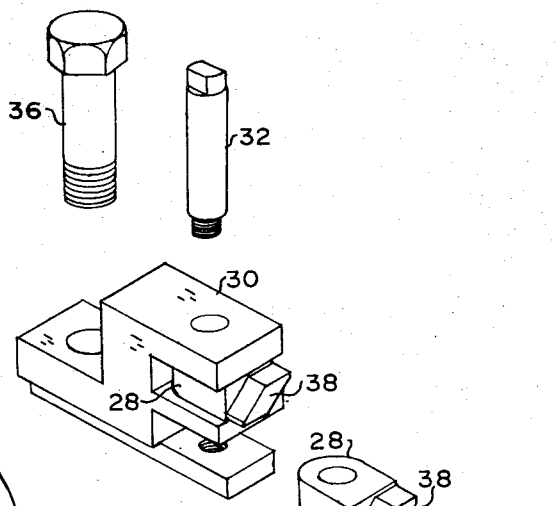
FIG. 2 is an exploded view of the construction of a pivotal hammer employed by the pulverizer.
Figure 3:
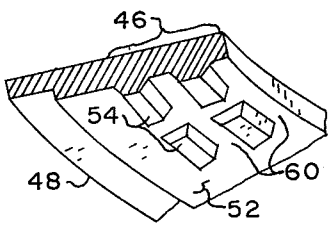
FIG. 3 is a partial view of the underside of an annular plate region of the stator of the pulverizer shown in FIG. 1.
Figure 1:
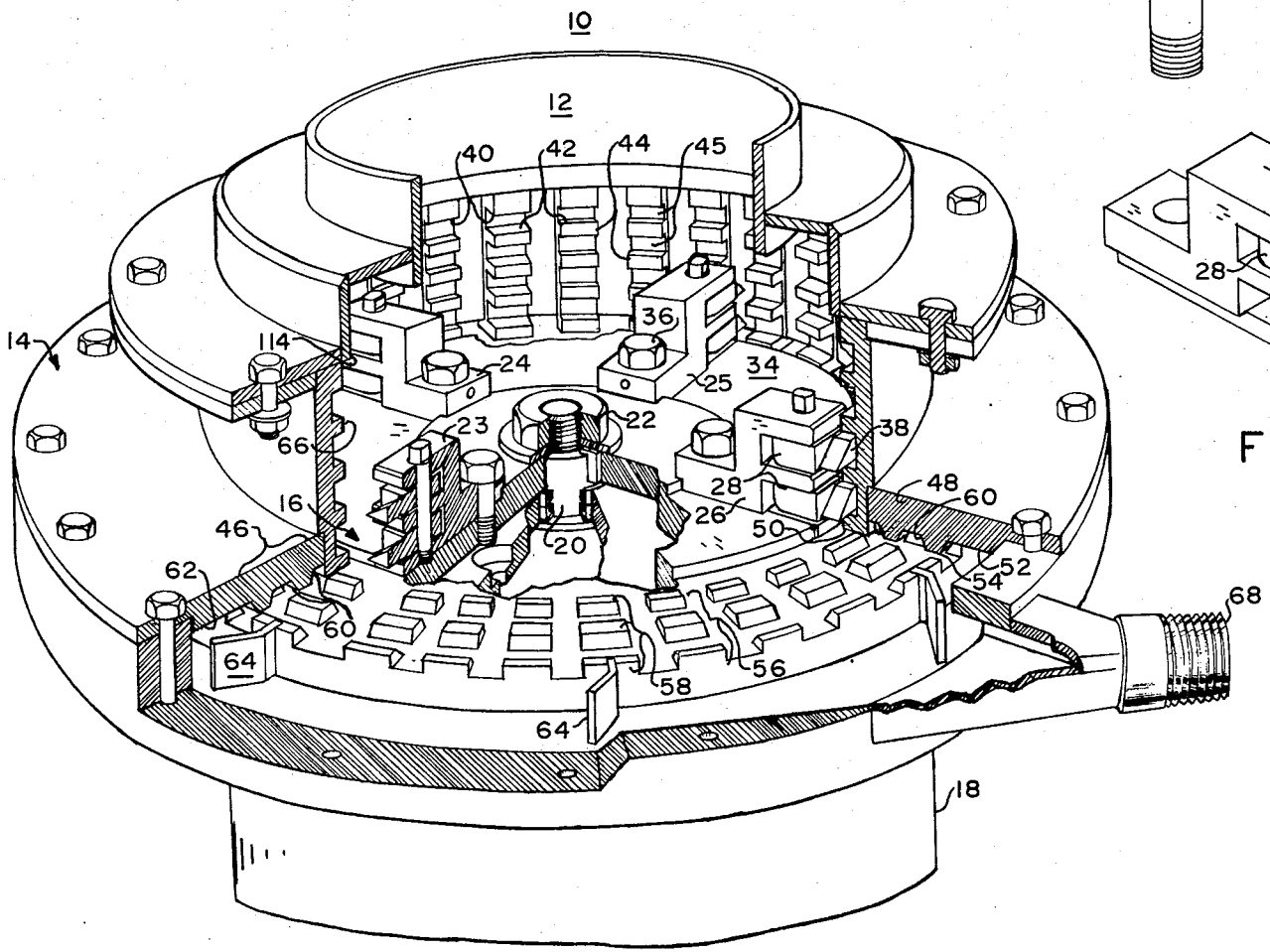
FIG. 1 is a pictorial view of a pulverizer as contemplated by this invention.

Referring to the drawings, pulverizer 10 includes a throat region 12 through which waste food is supplied.

Pulverizer 10 basically consists of stator 14 and rotor 16, the latter being driven by motor 18 via shaft 20, which is attached by means of nut 22. Hammer assemblies 23, 24, 25, and 26, spaced 90 degrees apart, each include first and second hammers 28 held on frame member 30 by pin 32. Each of these assemblies is attached to a generally flat plate central region 34 of rotor 16 by bolt 36. Hammers 28 have diagonally cut sides 38 with a height dimension which fits with a 0.020 to 0.030 inch clearance between upper and lower surfaces 40 and 42 of mating circular lands 44 in a tubular portion of stator 14. Four grooves 45, formed between the lands, are shown, as well as only two sets of mating hammers; but it is to be appreciated that additional hammers may be added above the two shown to operate in the remaining grooves 45 of stator 14. An annular extension 46 of stator 14 is formed by a generally horizontal stator plate 48, extending radially outward from the lower edge 50 of the tubular portion of stator 14. The lower surface 52 of this extension consists of radially and circumferentially spaced lands 54 which form a generally peripheral portion of stator 14. An outer annular portion 56 of rotor 16 has a like configured, but a complementary set of lands 58 which rotate within grooves 60 formed by the lands 54 of stator 14. Exterior of the outer edge of rotor plate 16 and stator 14 is an annular cavity 62 in which vanes 64, attached to rotor plate 16, operate and form a pump which picks up pulverized particles. Thus, the waste food, progressively pulverized, flows down through tubular cavity 66 of the device and out between the horizontally mated lands and grooves 58 and 60, respectively, where it is pumped out through exit opening 68.

Figure 4:
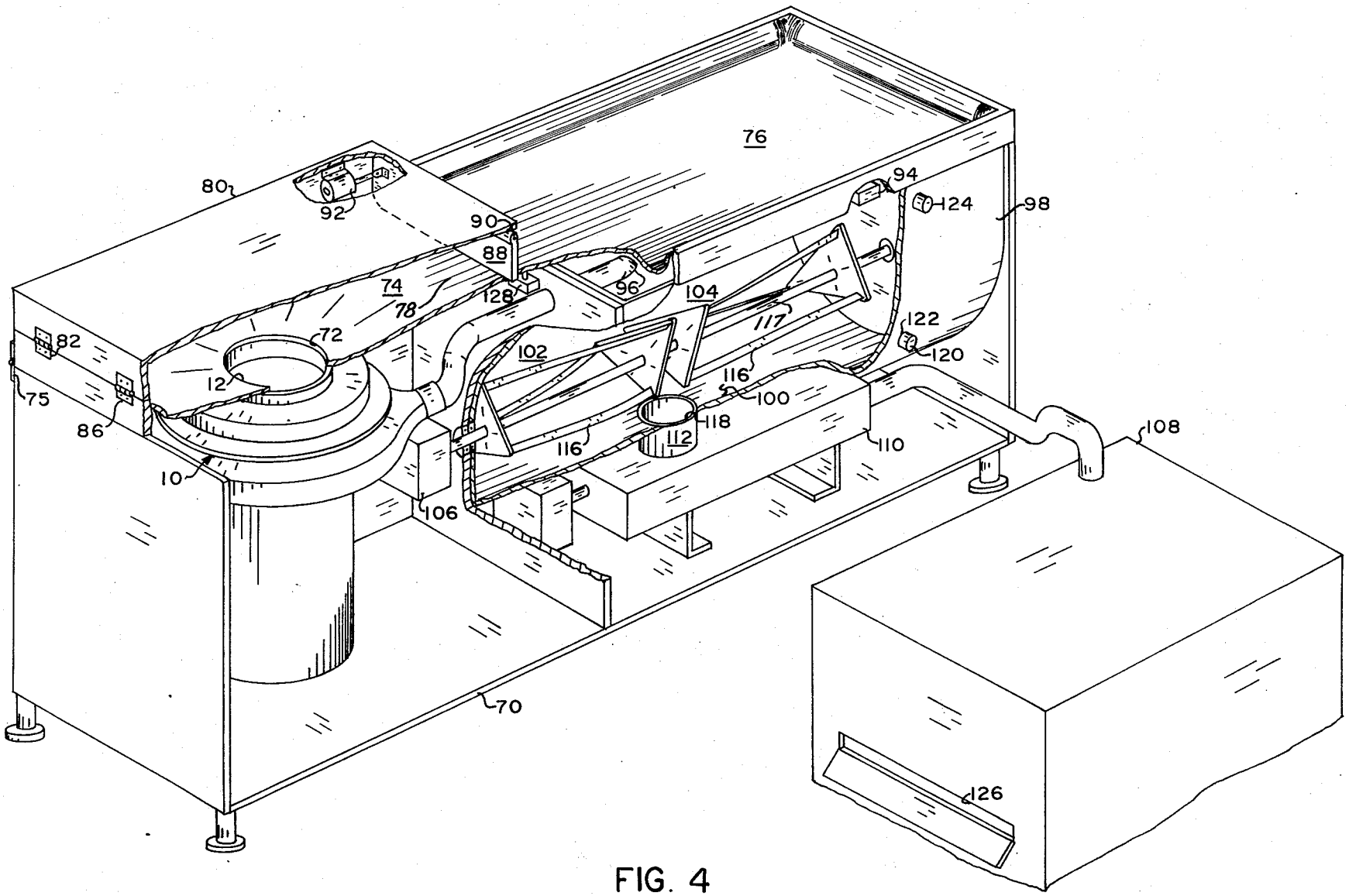
FIG. 4 is a pictorial view, partially schematic, of a waste food conversion system employing the pulverizer shown in FIGS. 1–3.

Referring to FIG. 4, pulverizer 10 is supported in cabinet 70 (by means not shown) with its opening aligned with an opening 72 in tray 74 hinged on the back by hinges 75. With tray 74 in an operating horizontal position as shown, waste food to be processed is placed on tray 74 in an opposite end region 76. The top region 78 around opening 72 is generally covered, in operation, by cover 80 hinged by hinges 82 and 86. A gate 88, pivotally supported by rod 90, is electrically operated by solenoid 92 which generally holds gate 88 open; but in the event of the occurrence of a piece of metal in waste food placed on tray 74, solenoid 92 is de-energized, closing gate 88. Metal is detected by metal detector 94 positioned on the underside of tray 74, and it provides a control output to solenoid 92. In addition to providing a gated opening, cover 86 also acts as an anti-kickback barrier to protect personnel from any articles which might be expelled through opening 72 from pulverizer 10.

The output 68 of pulverizer 10 is connected to the input 96 of buffer holding tank 98, which is configured with a rounded bottom and lower center region 100. Blade assemblies 102 and 104 conform to the bottom of tank 98 and are driven through axle 117 by motor 106. Buffer holding tank 98 is employed to accept an uneven flow of material from pulverizer 10 and to provide an even output flow. Inasmuch as material may be retained in holding tank 98 for a significant period of time, the blades function to maintain a uniform consistency and moisture in the pulverized material. Where this is not done, there would result stratification of the moisture, and this would complicate the drying process. Drying of the material is effected by double drum dryer 108 which is supplied from tank 98 at a selected rate by pump 110 through pipe 112 from a central, low point, output of tank 98.

OPERATION

Food waste is collected from plates, dishes, and trimming areas of a food service operation, and it is poured or placed on end region 76 of sorting tray 74. By visual inspection, non-edible matter is observed and removed by hand prior to the food waste being moved, by a hand-operated paddle, to the left toward drain opening 72. As a further procedure to remove harmful matter, both from the point of view of the contents of the final product and the operation of the pulverizer, the waste food is passed over metal detector 94; and when metal is detected, as, for example, because of the presence of a knife or fork, the metal detector is energized; and it applies a signal to solenoid 92 which operates gate 88 to block further movement of food waste to the left.

With gate 88 open, food waste is moved through tray drain 72 where it falls by gravity into throat 12 of pulverizer 10. Food waste is then deposited on rotor plate 16 where, by centrifugal force, it is moved laterally to inner circular wall 114, forming with rotor plate 16 a grinding bowl. The radially extending hammers 28, extended by centrifugal force, force the waste food between lands 44 of wall 114, causing the waste food to be reduced to small particles. The waste food is also forced downward and along inclined planes 38 of hammer 28. This motion is continuous until the waste food is essentially liquified and forced downward to the radial space formed between mating lands 58 of rotor 16 and lands 54 of stator 14. The material is then forced outward between these lands and further reduced in particle size. It then reaches vane pump cavity 62 where the pump vanes 64 force the material out through outlet 68 to tank 98.

In tank 98, emulsified food material is agitated continuously by mixing blades 116. The offset (not parallel with respect to drive axle 117) geometry of blades 116 is such that the food material is swept to the interior or center of mixing tank 98, which is directly over drain 118, and this facilitates movement through drain 118 into positive displacement-type pump 110. Low level sensor 120 is positioned at a point 122, and it senses food level dropping to this point; and when this occurs, sensor 120 turns off pump 110 (by means not shown) in order to prevent pumping without material present which may destroy the pump. In order to prevent overflow of tank 98, high level sensor 124 senses level at its indicated position and is connected (by means not shown) to turn off pulverizer 10 when material rises above the position of this sensor.

The emulsified food waste supplied to pump 110 is pumped at a selected rate to dehydrator 108 where the emulsified food is dried to a selected degree of dryness or moisture content (8 to 10 percent) and ejected through outlet 126 as a dried animal feed.

Safety cut-off switch 128 inhibits emulsifer motor 18 and mixing motor 106 (by means not shown) when tray 74 is raised for cleaning or service. This thus prevents any manual contact with the interior of emulsifier 10 or tank 98 when either is operating.

Having thus described my invention, what is claimed is:

1. A food processor comprising a pulverizer, in turn comprising:

a stator member comprising:

a vertically oriented interior surface, the top end of which forms an input opening to said pulverizer, and said surface having a plurality of vertically and circumferentially spaced lands and grooves, and a first circular plate extending around and radially outward from a lower end of said interior cylindrical surface, and having a lower, generally horizontal, surface comprising a plurality of concentrically and circumferentially spaced lands;

a motor and rotor member driven therefrom, and said rotor member comprising a second circular plate positioned for rotation about a vertical axis concentric with said cylindrical surface of said stator member, and further comprising:

at least one hammer rotably attached to said second circular plate for horizontal pivotal movement about a vertical axis, said hammer being positioned to pass within a groove formed between said lands of said cylindrical surface of said stator member, and a plurality of concentrically and circumferentially spaced lands and grooves in said second circular plate and positioned for mating rotation between said lands of said first circular plate of said stator member; and collection means including an annular passageway generally outboard of said circular plates for collecting pulverized material passing outboard and between said circular plates and for providing said material as a confined output flow.

2. A food processor as set forth in claim 1 further comprising:

buffer storage means comprising:

a tank, and means for connecting said confined flow to said tank, agitation means for maintaining a generally uniform consistency of material in said tank, and a fluid output connected to a bottom of said tank.

3. A food processor as set forth in claim 2 wherein said agitation means and the bottom of said tank are configured to move material toward said fluid output.

4. A food processor as set forth in claim 3 further comprising an elongated horizontal tray having an opening in one end region generally aligned with and above said input opening of said pulverizer, and whereby material deposited on said tray may be moved into said pulverizer.

5. A food processor as set forth in claim 4 further comprising:

an enclosure over said opening in said tray; and an openable gate in said enclosure positioned to admit material moved on said tray toward said opening.

* * * * *